US009650951B2

(12) United States Patent
Cleeves et al.

(10) Patent No.: US 9,650,951 B2
(45) Date of Patent: May 16, 2017

(54) SINGLE PISTON SLEEVE VALVE WITH OPTIONAL VARIABLE COMPRESSION RATIO CAPABILITY

(75) Inventors: James M. Cleeves, Redwood City, CA (US); Simon David Jackson, Redwood City, CA (US); Michael Hawkes, San Francisco, CA (US); Michael A. Willcox, Redwood City, CA (US)

(73) Assignee: PINNACLE ENGINES, INC., San Carlos, CA (US)

( * ) Notice: Subject to any disclaimer, the term of this patent is extended or adjusted under 35 U.S.C. 154(b) by 1315 days.

(21) Appl. No.: 13/270,200

(22) Filed: Oct. 10, 2011

(65) Prior Publication Data

US 2012/0089316 A1 Apr. 12, 2012

Related U.S. Application Data

(60) Provisional application No. 61/391,525, filed on Oct. 8, 2010, provisional application No. 61/501,462, filed (Continued)

(51) Int. Cl.
*F02B 75/04* (2006.01)
*F02D 15/04* (2006.01)

(Continued)

(52) U.S. Cl.
CPC ..... *F02B 75/042* (2013.01); *F01L 5/06* (2013.01); *F01L 7/04* (2013.01); *F02B 75/041* (2013.01); *F02D 15/04* (2013.01)

(58) Field of Classification Search
CPC ..... F02D 15/04; F02D 15/02; Y02T 10/18; F02B 75/041; F02B 75/04

(Continued)

(56) References Cited

U.S. PATENT DOCUMENTS 367,496 A 8/1887 Atkinson
1,082,004 A 12/1913 Anthony (Continued)

FOREIGN PATENT DOCUMENTS

CN 101427012 A 5/2009
CN 102135040 A 7/2011

(Continued)

OTHER PUBLICATIONS

Extended European Search Report issued in European Application No. 11831731, mailed Oct. 9, 2014.

(Continued)

*Primary Examiner* — Hai Huynh
*Assistant Examiner* — Raza Najmuddin
(74) *Attorney, Agent, or Firm* — Mintz Levin Cohn Ferris Glovsky and Popeo, P.C.

(57) ABSTRACT

An internal combustion engine can include a piston moving in a cylinder and a junk head disposed opposite the piston head in the cylinder. The junk head can optionally be moveable between a higher compression ratio position closer to a top dead center of the piston and a lower compression ratio position further from the top dead center position of the piston. At least one intake port can deliver a fluid comprising inlet air to a combustion chamber within the cylinder. Combustion gases can be directed out of the combustion volume through at least one exhaust port. One or both of the intake port and the exhaust port can be opened and closed by operation of a sleeve valve that at least partially encircles the piston. Related articles, systems, and methods are described.

23 Claims, 9 Drawing Sheets

Related U.S. Application Data on Jun. 27, 2011, provisional application No. 61/501,654, filed on Jun. 27, 2011.

(51) Int. Cl.

| | |
|---|---|
| ***F02D 15/00*** | (2006.01) |
| ***F01L 5/06*** | (2006.01) |
| ***F01L 7/04*** | (2006.01) |

(58) Field of Classification Search

USPC ..... 23/188.5, 190.12, 190.13, 196 V, 65 V, 23/65 VA, 65 VS, 71 VA, 312, 313, 314, 23/59.13, 53.6, 48 R, 48 AA, 48 C

See application file for complete search history.

(56) References Cited

U.S. PATENT DOCUMENTS

| | | | | |
|---|---|---|---|---|
| 1,097,947 | A | 5/1914 | Shaw | |
| 1,140,987 | A | 5/1915 | Kube | |
| 1,258,524 | A | 3/1918 | Berry | |
| 1,316,977 | A | 9/1919 | Ricardo | |
| 1,377,798 | A | 5/1921 | Berckenhoff | |
| 1,453,304 | A | 5/1923 | Charter | |
| 1,459,819 | A | 6/1923 | Bonner | |
| 1,472,549 | A | 10/1923 | Burtnett | |
| 1,497,206 | A | 6/1924 | Booton | |
| 1,502,291 | A | 7/1924 | Conway | |
| 1,550,643 | A | 8/1925 | Bullintgon | |
| 1,634,768 | A | 7/1927 | Bonner | |
| 1,644,954 | A | 10/1927 | Shearer | |
| 1,673,340 | A | 6/1928 | Schaeffer | |
| 1,761,935 | A * | 6/1930 | Schjolin | F01P 3/02 123/41.29 |
| 1,773,971 | A | 8/1930 | Dunn | |
| 1,812,323 | A | 6/1931 | Davison et al. | |
| 1,819,897 | A | 8/1931 | Johnson | |
| 1,823,770 | A | 9/1931 | Tartrais | |
| 1,837,870 | A | 12/1931 | Johnston | |
| 1,856,242 | A | 5/1932 | D'Aix | |
| 1,889,946 | A | 12/1932 | Cadwell | |
| 2,090,889 | A | 8/1937 | Howald | |
| 2,121,409 | A | 6/1938 | Ricardo | |
| 2,199,625 | A | 5/1940 | Benno | |
| 2,273,179 | A | 2/1942 | Davison | |
| 2,292,233 | A | 8/1942 | Lysholm | |
| 2,401,188 | A | 5/1946 | Prince | |
| 2,409,761 | A | 10/1946 | Hulsing | |
| 2,686,507 | A | 8/1954 | Lombardi | |
| 2,773,490 | A | 12/1956 | Miller | |
| 2,817,322 | A | 12/1957 | Miller | |
| 2,858,816 | A | 11/1958 | Prentice | |
| 2,937,631 | A | 5/1960 | Coyle | |
| 3,485,221 | A | 12/1969 | Feedback | |
| 3,533,429 | A | 10/1970 | Shoulders | |
| 3,780,719 | A | 12/1973 | Weiertz | |
| 3,948,241 | A | 4/1976 | Melchior | |
| 3,961,607 | A | 6/1976 | Brems | |
| 4,050,421 | A | 9/1977 | Cendak | |
| 4,057,040 | A | 11/1977 | Wax | |
| 4,104,995 | A | 8/1978 | Steinbock | |
| 4,516,537 | A | 5/1985 | Nakahara et al. | |
| 4,535,735 | A | 8/1985 | Yoshinaga et al. | |
| 4,815,421 | A | 3/1989 | Paul et al. | |
| 4,838,214 | A | 6/1989 | Barrett | |
| 4,856,463 | A | 8/1989 | Johnston | |
| 4,876,992 | A | 10/1989 | Sobotowski | |
| 4,928,658 | A | 5/1990 | Ferrenberg et al. | |
| 5,025,757 | A | 6/1991 | Larsen | |
| 5,054,438 | A | 10/1991 | Takashima | |
| 5,058,536 | A | 10/1991 | Johnston | |
| 5,113,805 | A | 5/1992 | Kawamura | |
| 5,127,375 | A | 7/1992 | Bowman et al. | |
| 5,188,067 | A | 2/1993 | Fontichiaro et al. | |
| 5,255,637 | A | 10/1993 | Schechter | |
| 5,445,117 | A | 8/1995 | Mendler | |
| 5,507,253 | A | 4/1996 | Lowi, Jr. | |
| 5,560,326 | A | 10/1996 | Merritt | |
| 5,623,894 | A | 4/1997 | Clarke | |
| 5,803,042 | A | 9/1998 | Bortone | |
| 6,039,011 | A | 3/2000 | Agalarov et al. | |
| 6,125,801 | A | 10/2000 | Mendler | |
| 6,205,963 | B1 * | 3/2001 | Davies | F01L 1/44 123/190.12 |
| 6,230,671 | B1 | 5/2001 | Achterberg | |
| 6,230,683 | B1 | 5/2001 | zur Loye et al. | |
| 6,390,041 | B2 | 5/2002 | Nakamura et al. | |
| 6,474,281 | B1 | 11/2002 | Walters | |
| 6,502,543 | B1 | 1/2003 | Arai et al. | |
| 6,994,060 | B2 | 2/2006 | Yoeda | |
| 7,004,119 | B2 | 2/2006 | Dardalis | |
| 7,559,298 | B2 * | 7/2009 | Cleeves | 123/48 R |
| 7,584,724 | B2 | 9/2009 | Berger | |
| 7,921,817 | B2 | 4/2011 | Cleeves | |
| 8,210,147 | B2 | 7/2012 | Cotton | |
| 8,365,697 | B2 | 2/2013 | Cleeves | |
| 8,413,619 | B2 | 4/2013 | Cleeves | |
| 8,459,227 | B2 | 6/2013 | Cotton | |
| 8,573,178 | B2 | 11/2013 | Cleeves | |
| 8,651,086 | B2 | 2/2014 | Cleeves | |
| 8,789,499 | B2 | 7/2014 | Alonso | |
| 8,904,998 | B2 | 12/2014 | Cleeves | |
| 2004/0244758 | A1 | 12/2004 | Weng et al. | |
| 2008/0115771 | A1 | 5/2008 | Elsbett | |
| 2008/0127947 | A1 | 6/2008 | Hofbauer et al. | |
| 2009/0107139 | A1 | 4/2009 | Berger | |
| 2010/0147269 | A1 | 6/2010 | Flowers et al. | |
| 2010/0192916 | A1 * | 8/2010 | Turner | F01L 5/06 123/48 C |
| 2011/0041799 | A1 | 2/2011 | Cleeves et al. | |
| 2012/0037100 | A1 | 2/2012 | McAlister et al. | |
| 2012/0073526 | A1 | 3/2012 | Dion et al. | |
| 2012/0085302 | A1 | 4/2012 | Cleeves | |
| 2012/0085309 | A1 | 4/2012 | Cleeves et al. | |
| 2012/0090298 | A1 | 4/2012 | Cleeves | |
| 2012/0158273 | A1 | 6/2012 | Cleeves et al. | |
| 2012/0330534 | A1 | 12/2012 | Cleeves et al. | |
| 2013/0220279 | A1 | 8/2013 | Cleeves | |
| 2014/0000567 | A1 | 1/2014 | Cleeves | |
| 2014/0007840 | A1 | 1/2014 | Cleeves et al. | |
| 2014/0083222 | A1 | 3/2014 | Cleeves | |
| 2014/0102418 | A1 | 4/2014 | Babu et al. | |
| 2014/0158093 | A1 | 6/2014 | Cleeves et al. | |
| 2014/0182549 | A1 | 7/2014 | Cleeves | |
| 2014/0311431 | A1 | 10/2014 | Cleeves | |
| 2014/0331646 | A1 | 11/2014 | Cleeves | |
| 2014/0373802 | A1 | 12/2014 | Cleeves | |
| 2015/0040876 | A1 | 2/2015 | Cleeves et al. | |

FOREIGN PATENT DOCUMENTS

| | | | |
|---|---|---|---|
| DE | 643470 | * | 4/1937 |
| DE | 643470 | C | 4/1937 |
| DE | 19813398 | C1 | 9/1999 |
| DE | 10023442 | A1 | 11/2001 |
| EP | 1857801 | A1 | 11/2007 |
| FR | 348575 | A | 4/1905 |
| FR | 497282 | A | 12/1919 |
| FR | 805866 | A | 12/1936 |
| FR | 2900683 | A1 | 11/2007 |
| FR | 2900974 | A1 | 11/2007 |
| GB | 02015 | A | 0/1909 |
| GB | 16846 | * | 7/1912 |
| GB | 382670 | A | 10/1932 |
| GB | 542009 | A | 12/1941 |
| GB | 635664 | A | 4/1950 |
| GB | 746820 | A | 3/1956 |
| GB | 1466311 | A | 3/1977 |
| GB | 1516982 | A | 7/1978 |
| GB | 2376503 | A | 12/2002 |
| GB | 2431695 | A | 5/2007 |
| GB | 2432398 | A | 5/2007 |
| JP | S55139942 | A | 11/1980 |
| JP | 56-106040 | A | 8/1981 |
| JP | 61-51439 | | 4/1986 |

(56) References Cited

FOREIGN PATENT DOCUMENTS

| | | | | |
|---|---|---|---|---|
| JP | 62-007909 | | | 1/1987 |
| JP | S63-98414 | A | | 4/1988 |
| JP | S63-154821 | | | 6/1988 |
| JP | 01-313608 | | | 12/1989 |
| JP | 04-001453 | A | | 1/1992 |
| JP | 09-280370 | | | 10/1997 |
| JP | 10-038083 | | | 2/1998 |
| JP | 10-311231 | A | | 11/1998 |
| JP | 2001-073780 | A | | 3/2001 |
| JP | 2004-239182 | A | | 8/2004 |
| JP | 2005-113839 | A | | 4/2005 |
| JP | 2008-505282 | A | | 2/2008 |
| TW | 200610880 | A | | 4/2006 |
| WO | WO79/00650 | | * | 9/1979 |
| WO | WO-79/00650 | A1 | | 9/1979 |
| WO | WO-2006/002982 | A1 | | 1/2006 |
| WO | WO-2007/006469 | A2 | | 1/2007 |
| WO | WO-2007/010186 | A1 | | 1/2007 |
| WO | WO-2007/057660 | A1 | | 5/2007 |
| WO | WO-2007083159 | A1 | | 7/2007 |
| WO | WO-2007/121086 | A2 | | 10/2007 |
| WO | WO 2014/047395 | | | 3/2014 |
| WO | WO 2014/183065 | | | 11/2014 |
| WO | WO 2014/205291 | | | 12/2014 |
| WO | WO 2015/013696 | | | 1/2015 |

OTHER PUBLICATIONS

Heywood, John B., Internal Combustion Engine Fundamentals, Chapter 1—Engine Types and their Operation, Apr. 1988, p. 37, McGraw-Hill, Inc.

Heywood, John B., Internal Combustion Engine Fundamentals, Chapter 5—Ideal Models of Engine Cycles, Apr. 1988, pp. 170, 175, 184, and 185, McGraw-Hill, Inc.

HeyWood, John B., Internal Combustion Engine Fundamentals, Chapter 9—Combustion in Spark-Ignition Engines, Apr. 1988, p. 393, McGraw-Hill, Inc.

Heywood, John B., Internal Combustion Engine Fundamentals, Chapter 12—Engine Heat Transfer, Apr. 1988, pp. A and B, McGraw-Hill, Inc.

Heywood, John. B., "Internal Combustion Engine Fundamentals", Ch. 13—Engine Friction and Lubrication, Apr. 1988, p. C, McGraw-Hill, Inc.

International PCT Search Report dated Jan. 23, 2014 for PCT application No. PCT/US2013/049160.

International Search Report dated Mar. 19, 2012 for PCT application No. PCT/US2011/055486.

Law, Don et al., Controlled Combustion in an IC-Engine with Fully Variable Valve Train, Homogeneous Charge Compression Ignition (HCCI) Combustion—SP 1623, Mar. 2001, pp. 17-18, Society of Automotive Engineers, Inc., Warrendale, PA, USA.

Oakley, Aaron et al., Experimental Studies on Controlled Auto-Ignition (CAI) Combustion of Gasoline in a 4-stroke Engine, Homogeneous Charge Compression Ignition (HCCI) Combustion—SP 1623, Mar. 2001, pp. 105-109, Society of Automotive Engineers, Inc. Warrendale, PA, USA.

Rennie, Gabriele, Engine Shows Diesel Efficiency without the Emissions, Homogeneous Charge Compression Ignition Engine—Lawrence Livermore National Laboratory, S&TR Apr. 2004, pp. 17-19.

International Search Report and Written Opinon dated Feb. 6, 2012, for corresponding PCT application No. PCT/US2011/055457.

* cited by examiner

SINGLE PISTON SLEEVE VALVE WITH OPTIONAL VARIABLE COMPRESSION RATIO CAPABILITY

CROSS-REFERENCE TO RELATED APPLICATIONS

This application claims priority under 35 U.S.C. §119(e) to U.S. provisional patent application Ser. No. 61/391,525 filed on Oct. 8, 2010 and entitled "Single Piston Sleeve Valve," under 35 U.S.C. §119(e) to U.S. provisional patent application Ser. No. 61/501,462 filed on Jun. 27, 2011 and entitled "Single Piston Sleeve Valve with Optional Variable Compression Ratio," under 35 U.S.C. §119(e) to U.S. provisional patent application Ser. No. 61/501,654 filed on Jun. 27, 2011 and entitled "High Efficiency Internal Combustion Engine," and under 35 U.S.C. §120 to Patent Cooperation Treaty Application No. PCT/US2011/055457 filed on Oct. 7, 2011 and entitled "Single Piston Sleeve Valve with Optional Variable Compression Ratio Capability." The disclosure of each application listed in this paragraph is incorporated by reference herein in its entirety.

TECHNICAL FIELD

The subject matter described herein relates generally to internal combustion engines and more particularly to those that include sleeve valves that can provide one or more of air and/or fuel intake and exhaust from a cylinder that contains a single piston.

BACKGROUND

A sleeve valve as employed in an internal combustion engine generally includes one or more machined sleeves that fit between a piston and a cylinder wall. Conventional sleeve valves generally rotate and slide to periodically align one or more ports in the sleeve valve body with inlet and/or exhaust ports formed in the cylinder walls in accordance with the cycle requirements of the engine.

Sleeve valves have been described for use in opposed piston engines in which two pistons share a single cylinder such that no cylinder head is needed. For example, co-owned U.S. Pat. No. 7,559,298, which is incorporated herein by reference, describes such an engine configuration.

SUMMARY

In one aspect of the current subject matter, a system, which can be an internal combustion engine, includes a piston that moves, for example with a reciprocating motion within a cylinder of an internal combustion engine, a crankshaft connected to the piston by a connecting rod, a junk head disposed opposite the piston proximate to a first end of the cylinder, and a first sleeve valve associated with a first port connecting to a combustion chamber defined at least in part by a head of the piston, an internal surface of the junk head, and the first sleeve valve. The crankshaft rotates under influence of movement of the piston in the cylinder in accordance with an engine speed commanded by a throttle control. The first sleeve valve at least partially encircles the piston and opens and closes the first port by first movement between a first open position and a first closed position. A first sealing edge of the first sleeve valve is urged into contact with a first valve seat at the first closed position such that the first sealing edge is closer to the first end of the cylinder at the first closed position than at the first open position. The first movement includes the first sleeve valve temporarily ceasing its motion in a direction aligned with an axis of the cylinder at the first closed position and at the first open position.

In an interrelated aspect, a method includes opening a first sleeve valve associated with a first port connecting to a combustion chamber disposed within a cylinder of an internal combustion engine and defined at least in part by a head of a piston that moves within the cylinder, an internal surface of a junk head disposed proximate to a first end of the cylinder opposite the piston, and the first sleeve valve; closing the first sleeve valve; and rotating a crankshaft connected to the piston by a connecting rod such that the crankshaft rotates under influence of movement of the piston in the cylinder in accordance with an engine speed commanded by a throttle control. The first sleeve valve at least partially encircles the piston. The opening of the sleeve valve includes moving the first sleeve valve to an open position at which the first sleeve valve temporarily ceases its motion in a direction aligned with an axis of the cylinder. The closing of the sleeve valve includes moving the first sleeve valve to a first closed position at which the first sleeve valve temporarily ceases its motion in the direction aligned with the axis of the cylinder and at which a sealing edge of the sleeve valve is urged into contact with a valve seat such that the sealing edge is closer to the first end of the cylinder at the closed position than at the open position.

In another interrelated aspect, a method includes monitoring operation characteristics of an internal combustion engine to generate engine data, receiving a throttle input from a throttle control of the internal combustion engine, determining a preferred compression ratio within the combustion chamber based on the engine data and the throttle input, and commanding a junk head translation system that varies a distance between a junk head and a top dead center position of a piston from a first cycle of the internal combustion engine to a second, later cycle of the internal combustion engine. The internal combustion engine includes the piston moving in a cylinder and the junk head disposed proximate to a first end of the cylinder opposite the piston. The commanding includes causing the junk head translation system to move the junk head closer to the top dead center position of the piston if the preferred compression ratio is greater than a current compression ratio and away from the top dead center position of the piston if the preferred compression ratio is less than the current compression ratio.

In some variations, any or all of the following features can optionally be included in any feasible combination. The movement of the first sleeve valve between the open position and the closed position can be substantially parallel to the central axis of the cylinder. A coolant circulation system can optionally cause coolant to flow through one or more coolant channels in the junk head to maintain an internal surface of the junk head at or below a target junk head temperature. An ignition source, for example one or more spark plugs, can optionally be disposed in the junk head. The system can also optionally include a second valve associated with a second port connecting to the combustion chamber. The second valve can optionally include either a second sleeve valve at least partially encircling the junk head, or one or more poppet valves disposed in the junk head. If the second valve is the second sleeve valve, the second sleeve can open and close the second port by second movement between a second open position and a second closed position. The second closed position can optionally include a second sealing edge of the second sleeve valve being urged into contact with a second valve seat such that the second sealing edge is further from the first end of the cylinder at the second closed position than at the second open position. The second movement can optionally include the second sleeve valve ceasing its motion in the direction aligned with the axis of the cylinder both at the second closed position and at the second open position.

The first port can optionally include an intake port through which at least one of intake air and an air-fuel mixture is delivered to the combustion chamber, and the second port can optionally include an exhaust port through which exhaust gases resulting from combustion of a combustion mixture in the combustion chamber are exhausted. Alternatively, the second port can optionally include an intake port through which at least one of intake air and an air-fuel mixture is delivered to the combustion chamber, and the first port can optionally include an exhaust port through which exhaust gases resulting from combustion of a combustion mixture in the combustion chamber are exhausted.

An active cooling system associated with at least one of the first sleeve valve and the second valve can optionally be included to maintain the at least one of the first sleeve valve and the second valve at or below a target valve temperature. If the second valve is the poppet valve, the active cooling system can optionally include an oil supply tube inserted into a valve stem of the poppet valve to deliver oil near a valve head of the poppet valve and thereby maintain an internal surface valve head at or below the target valve head temperature.

A junk head translation system can optionally cause movement of the junk head in the cylinder such that a distance of the junk head from a top dead center position of the piston is variable from a first cycle of the internal combustion engine to a second, later cycle of the internal combustion engine. A controller can be configured to perform operations that can include monitoring operation characteristics of the internal combustion engine to generate engine data, receiving a throttle input from the throttle control, determining a preferred compression ratio within the combustion chamber based on the engine data and the throttle input, and commanding the junk head translation system to cause movement of the junk head parallel to the central axis of the cylinder to provide the preferred compression ratio. The command can cause the junk head translation system to move the junk head closer to the top dead center position of the piston if the preferred compression ratio is greater than a current compression ratio and away from the top dead center position of the piston if the preferred compression ratio is less than the current compression ratio. The engine data can optionally include at least one of a current engine speed, a current engine load, a detection of a premature detonation within the combustion chamber, and a current operation of a turbocharger or a supercharger that pressurizes and therefore adds heat to inlet air delivered to the combustion chamber. The junk head translation system can vary the distance between the junk head and the top dead center position of the piston on a time scale that is substantially longer than a single engine cycle of the internal combustion engine.

In other optional variations, an elastic rebound mechanism can optionally bias the junk head against a stop with a preload force directed away from the first end of the cylinder. The preload force can be sufficient to retain the junk head against the stop up to a threshold combustion chamber pressure such that the junk head moves toward the first end of the cylinder to increase a combustion chamber volume during an engine cycle when the threshold combustion chamber pressure is exceeded.

The controller unit can optionally be implemented in hardware or software or a combination of both. The moving of the junk head can cause an increase or decrease in a compression ratio within the cylinder, for example in response to throttle commands. In some examples, a lower compression ratio can be provided when the engine is operating at a low speed under high loads. At a higher engine speed with a high load, a higher compression ratio can be provided. A turbocharger or supercharger can optionally be used in conjunction with an engine that includes one or more of the features described herein. Boosting of the intake air pressure for high power operation can coincide with a reduction in the compression ratio, for example to reduce incidence of uncontrolled detonation or "knocking" in the cylinder. During light to medium load operation at a wide range of speeds, for example, the compression ratio can be high.

Systems and methods consistent with this approach are described as well as articles that comprise a tangibly embodied machine-readable medium operable to cause one or more machines (e.g., computers, etc.) to result in operations described herein. Similarly, computer systems are also described that may include a processor and a memory coupled to the processor. The memory may include one or more programs that cause the processor to perform one or more of the operations described herein.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

The accompanying drawings, which are incorporated in and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

Implementations of the current subject matter provide methods, systems, articles or manufacture, and the like that can, among other possible advantages, provide engines in which a sleeve valve is used in conjunction with a cylinder containing a single piston. In contrast to conventional sleeve valves that typically include a helical, rotational, or otherwise generally continuous motion, sleeve valves consistent with one or more implementations of the current subject matter can move intermittently such that a stop in motion occurs at a closed position as a leading or sealing edge of the sleeve valve is urged into contact with a valve seat and a reversal in motion occurs as the leading or sealing edge disengages from the valve seat to cause the valve to open.

According to one or more implementations of the current subject matter, only one moveable piston is positioned within the cylinder and connected to a crankshaft instead of having two pistons that are attached to crankshafts. The other piston, which can be referred to as a "junk head" or "stationary piston," can be held stationary. In the foregoing explanations, the term "junk head" is used to refer to a structure that can have one or more physical features that are similar to a traditional piston (e.g. one or more compression or oil-sealing piston rings, positioning in a cylinder opposite a traditional piston as in an opposed piston engine, etc.), but that is not attached to a crankshaft or other means of transferring combustion energy to useful work. Alternatively, consistent with one or more implementations of the current subject matter, the junk head can be movable, for example in accordance with one or more throttle conditions of the engine, to vary the cylinder geometry and thereby enable variable compression ratio operation of the engine.

As noted above, a sleeve valve consistent with implementations of the current subject matter may move in a reciprocating path between a first position, where at least one port is open, and a second position, where the sleeve valve closes the first port.

Figure 1:
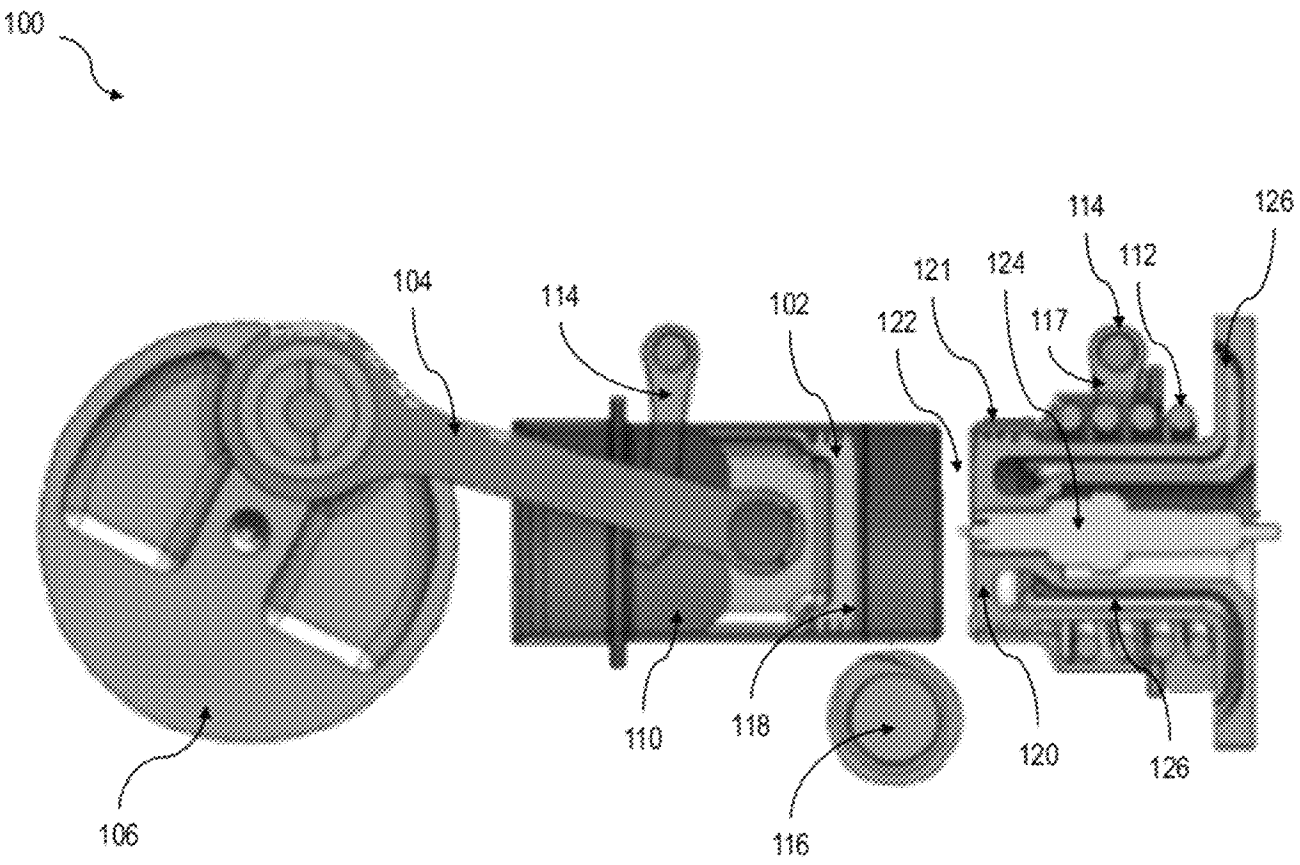
FIG. 1 shows a cross-sectional diagram showing components of a single piston engine with sleeve valves.

FIG. 1 shows a cross-sectional view illustrating features of an engine 100 consistent with one or more implementations of the current subject matter. A first, active piston 102 is connected by a connecting rod 104 to a crankshaft 106. The active piston 102 is located within a cylinder (not shown in FIG. 1) and has positioned at least partially around its circumference a sleeve valve 110 that moves in an intermittent manner from an open position to a closed position under the influence of one or more springs (not shown), rocker arms 114, cams 116, push rods connecting the rocker arm and the cam (not shown in FIG. 1), and the like to control flow of air, air and fuel, or exhaust through a port (not shown in FIG. 1) which can be an intake port or an exhaust port depending on the specific engine configuration.

Positioned opposite the piston head 118 in the cylinder is a junk head 120. Unlike the first piston 102, the junk head 120 is not attached, either directly or via a connecting rod, to a crankshaft for power output. In some implementations discussed in greater detail below, the junk head 120 can be connected to a crank or some other junk head translation mechanism or system that allows the position of the junk head 120 in the cylinder to be adjusted. Also unlike the first piston 102, in at least some implementations the junk head 120 does not experience cyclical movement during an engine cycle. In other implementations however, the junk head can be coupled to an elastic rebound mechanism such as a spring or other device that facilitates a peak pressure limitation mode of operation. In some implementations, the junk head 120 can be stationary or otherwise fixed in position in the cylinder such that the compression ratio within the cylinder remains constant. Alternatively, and consistent with implementations of the current subject matter, the junk head 120 can be moved or otherwise translated along the central axis of rotation of the cylinder to increase or decrease the size of the combustion volume or chamber 122 within the cylinder, for example from one cycle to the next, and thereby enable an engine to provide variable compression ratios through changes in the geometry of the combustion chamber 122.

In the view of FIG. 1, a second sleeve valve 119 can also be positioned at least partially around the junk head 120 to control flow through a second port (not shown), which can be an intake port or an exhaust port. This second sleeve valve 121 can have associated with it a rocker arm 114 as well as one or more springs 112, cams (not shown in FIG. 1), etc. In some implementations, either or both of the sleeve valves 110 and 121 can experience substantially linear, reciprocating motion parallel to a central axis of rotation of the cylinder such that a seal is provided by urging a sealing edge of each sleeve valve 110, 121 against a respective valve seat in a closed position of the sleeve valve 110, 121.

In one or more implementations, one or more spark plugs or other ignition sources 124 can be positioned at or near the center of the combustion chamber 122 through the junk head 120. The junk head 120 can also be directly cooled with flow through coolant, for example through one or more coolant channels 126, such that it can be maintained at an optimized temperature. A relatively reduced temperature of internal surfaces of the junk head 120 contacting a combustion mixture within the combustion chamber 122 can therefore be maintained so that the compression ratio of the engine 100 can be raised and the knock resistance can be improved.

In one example of the current subject matter illustrated in FIG. 2, an engine 200 includes a junk head that includes a poppet valve assembly 202 positioned centrally in the junk head 120 and one or more spark plugs or other ignition sources 124 positioned off the center axis also in the junk head 120. As shown in FIG. 2, the one or more spark plugs or other ignition sources 124 can be offset from the center of the combustion chamber 122 (i.e. the volume between the piston head 118 and the junk head 120 as further defined at least by cylinder walls of the engine body 204, and, in some implementations, by at least one sleeve valve 110. More than one spark plug or other ignition source 124 can be included to enhance the burn rate of the mixture independent of the turbulence type or magnitude generated within the combustion chamber (e.g. by air or other gas flows via the intake and/or exhaust valves, by motion of the piston 102, by the shape of the piston head 118, or the like). Implementations of the current subject matter can also include more than one poppet valve disposed in the junk head. For example, two or more poppet valves can be positioned offset from the cylinder centerline. One or more spark plugs or other ignition sources 124 can be positioned either offset from the cylinder centerline as shown in FIG. 2, or on or near the cylinder centerline if the poppet valve or valves 202 are offset from the cylinder centerline.

Figure 2B:
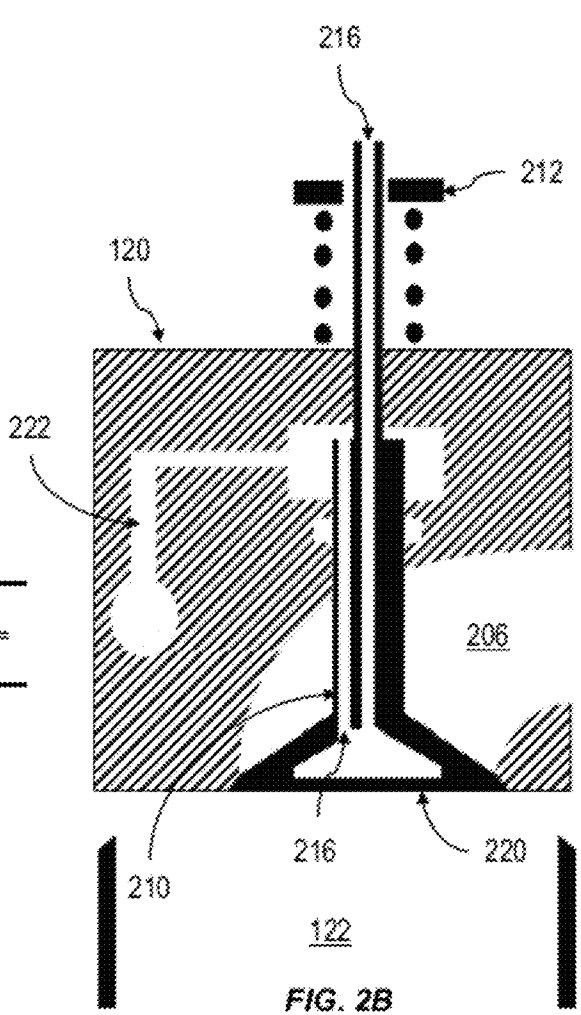
FIG. 2A and FIG. 2B show cross-sectional diagrams showing components of a single piston engine with a sleeve valve and a poppet valve.
Figure 2A:
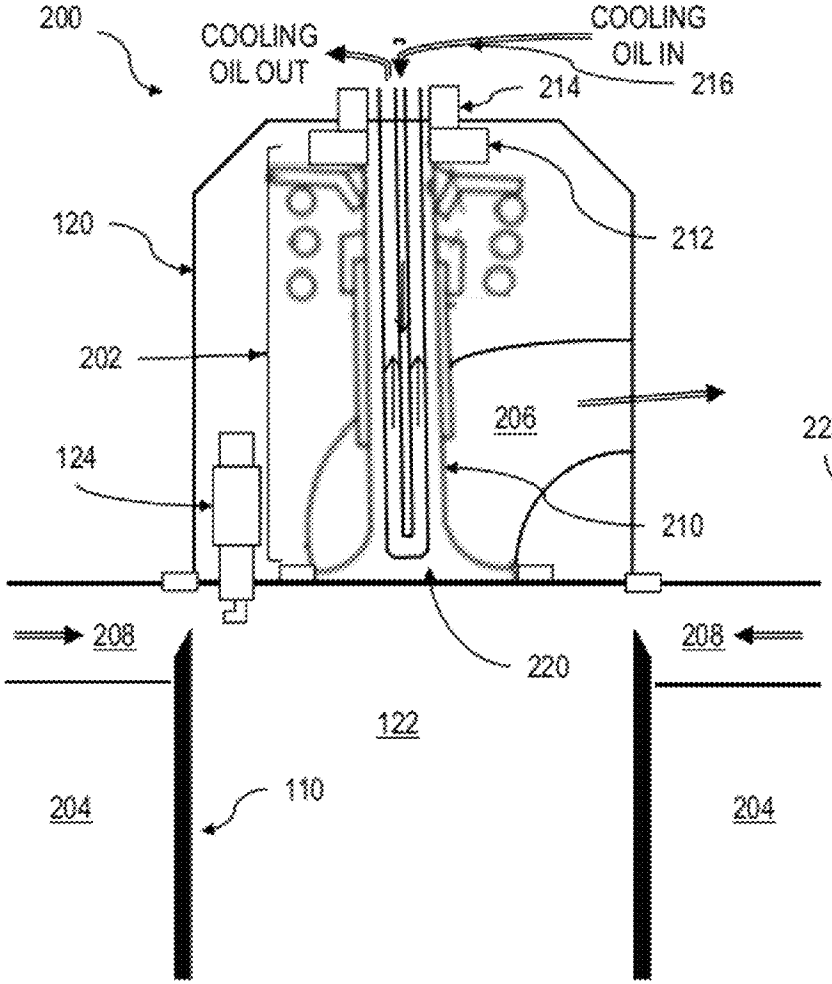

While the implementation illustrated in FIG. 2A and FIG. 2B is configured for use with a stationary junk head 120, use of one or more poppet valves 202 mounted in a moveable junk head is also within the scope of the current subject matter. For example, the poppet valve 202 in the movable junk head 120 can be actuated by a traditional valve train that moves with the moveable junk head 120, or by a hydraulic actuation similar to that used in the Fiat Multiair system that allows a valve actuation cam etc. to be stationary while the hydraulic connection to the poppet valve 202 is maintained by a slidable connection.

The poppet valve 202 can, in one implementation, be used to open and close an exhaust port 206 while a sleeve valve 110 opens and closes an intake port 208. Such a configuration can be used to reduce heat losses out of the combustion chamber. Alternatively, the first port 206 can be an intake port controlled by operation of the poppet valve 202 while the sleeve valve 110 controls flow of exhaust gases through the second port 208. This second configuration can enhance the knock resistance of the engine as a sleeve valve 110 used as an exhaust valve is generally easier to maintain at a lower temperature than is a poppet valve used for controlling an exhaust port.

Using a sleeve valve 110 as the intake valve can enable high flow rates and low restrictions for either tumble or swirl styles of mixture motion enhancement, for example as described in co-pending and co-owned international patent application no. PCT/US2011/027775 ("Multi-Mode High Efficiency Internal Combustion Engine"), the disclosure of which is incorporated by reference herein. If the engine is run as a diesel, resistance to knock (e.g. premature detonation of the air-fuel mixture) can be a lesser concern, so an exhaust poppet valve may not require active cooling. However, a spark ignited engine designed for high efficiency can merit ensuring that the valve is well cooled.

In an implementation in which only one poppet valve 202 is disposed in the junk head 120, the poppet valve 202 can optionally be of larger diameter than a conventional poppet valve and can also have a large-diameter stem 210 to conduct heat away from the valve head 220 more effectively than a smaller conventional valve. Such a valve can optionally also be made of a highly conductive material, such as for example a high-strength aluminum alloy. Alternatively or in addition, the valve stem 210 and/or body can be filled with a cooling fluid, for example sodium in a steel valve.

Alternatively, and as shown in FIG. 2A and FIG. 2B, the valve stem 210, actuator 212, and keeper 214 can have access holes such that an oil supply tube 216 can be inserted into the valve stem 210. The oil supply tube 216 can deliver oil near the valve head 220 inside the valve stem 210 and the clearance between the oil supply tube 216 and the valve stem 210 can allow the oil flow to exit. The oil supply tube 216 can optionally be rigid and fixed to the block, for example such that the differential motion between the valve and the engine/oil tube creates a volume change in the valve oil passages so that oil is drawn into the valve as the valve opens and ejected it as the valve closes. High heat transfer coefficients and high flow rates can be maintained with this jet and valve motion configuration so the poppet valve 202 can be maintained at temperatures below the temperature the oil would start to decompose. This approach can be used with all valve material choices. A check valve can optionally be included in or upstream of the oil supply tube or passage 216 to ensure that this pumping action produces flow of the cooling oil through the valve passages. Pumping action can also be obtained by varying the valve section where the valve stem 210 passes through a fixed cavity supplied with oil. Oil can additionally be fed from a pressurized cavity 222 without valve-induced pumping action, for example as shown in FIG. 2B.

Figure 3:
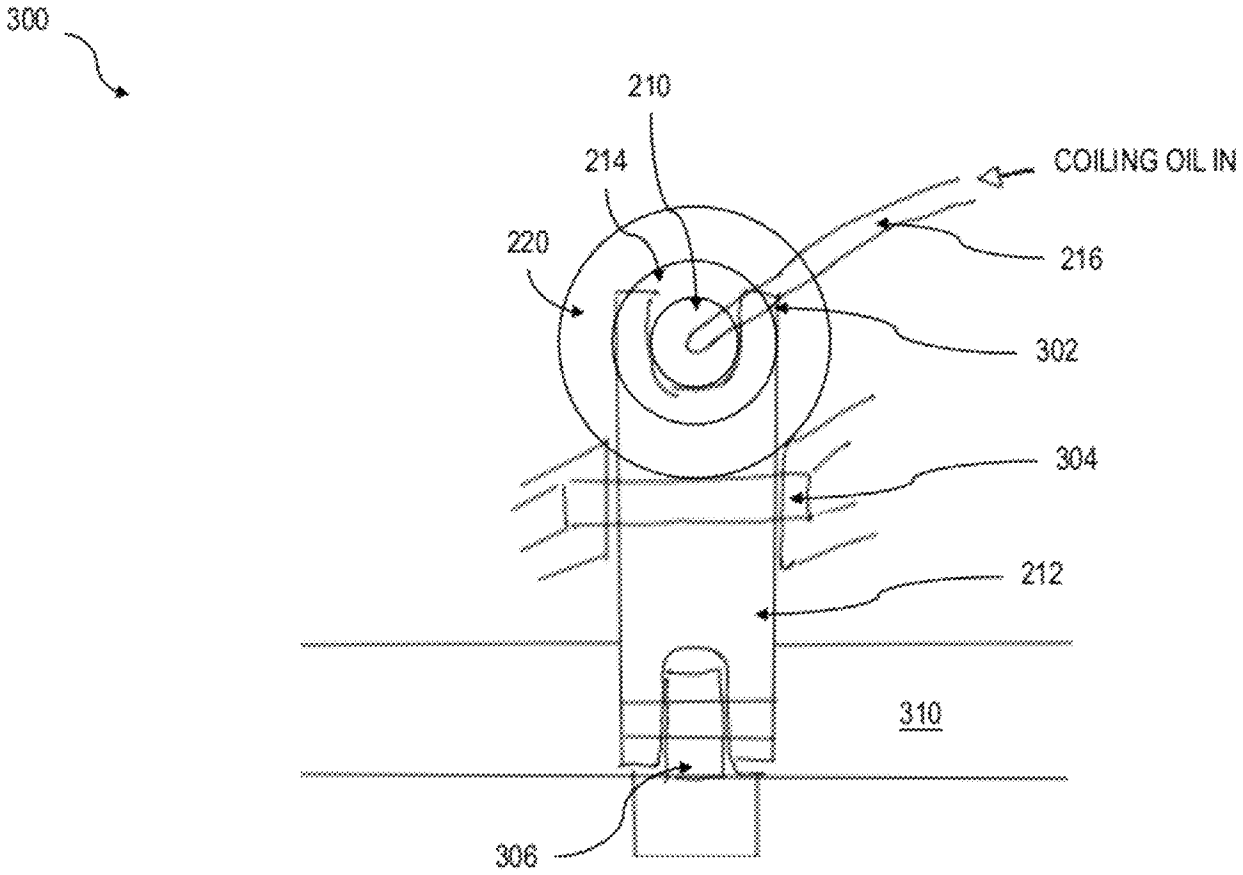
FIG. 3 shows a top elevation view of a poppet valve actuator with coolant oil flows.

FIG. 3 shows a top view of an actuator assembly 300 for an implementation having a poppet valve that includes active cooling as described above in reference to FIG. 2. The actuator 212 can include a forked rocker end 302 that is urged against the keeper 214 as it pivots upon a pivot point or block 304 due to the influence of a follower 306 on a rotating cam 310. If more than one poppet valve is employed, a pair of such rockers can be used, or alternatively a single rocker can actuate multiple valves.

The compression ratio, CR, for an internal combustion engine is defined as $$CR = \frac{\frac{\pi}{4} b^2 s + V_c}{V_c} \tag{1}$$

where b is the diameter of the cylinder bore, s is the stroke length of the piston, and $V_c$ is the clearance volume within the cylinder, which includes the minimum volume of the space at the end of the compression stroke, i.e. when the piston reaches top dead center (TDC). Accordingly, for a fixed piston stroke length and cylinder bore, the compression ratio can be increased by reducing the clearance volume and decreased by enlarging the clearance volume. In implementations of the current subject matter, for example for an engine including one or more of the features illustrated in FIG. 4, changes in the clearance volume can be achieved by incorporation of a moveable junk head 120 that can be translated within the cylinder at a rate that is determined by the current throttle condition rather than by the speed at which the engine is operating.

Figure 4:
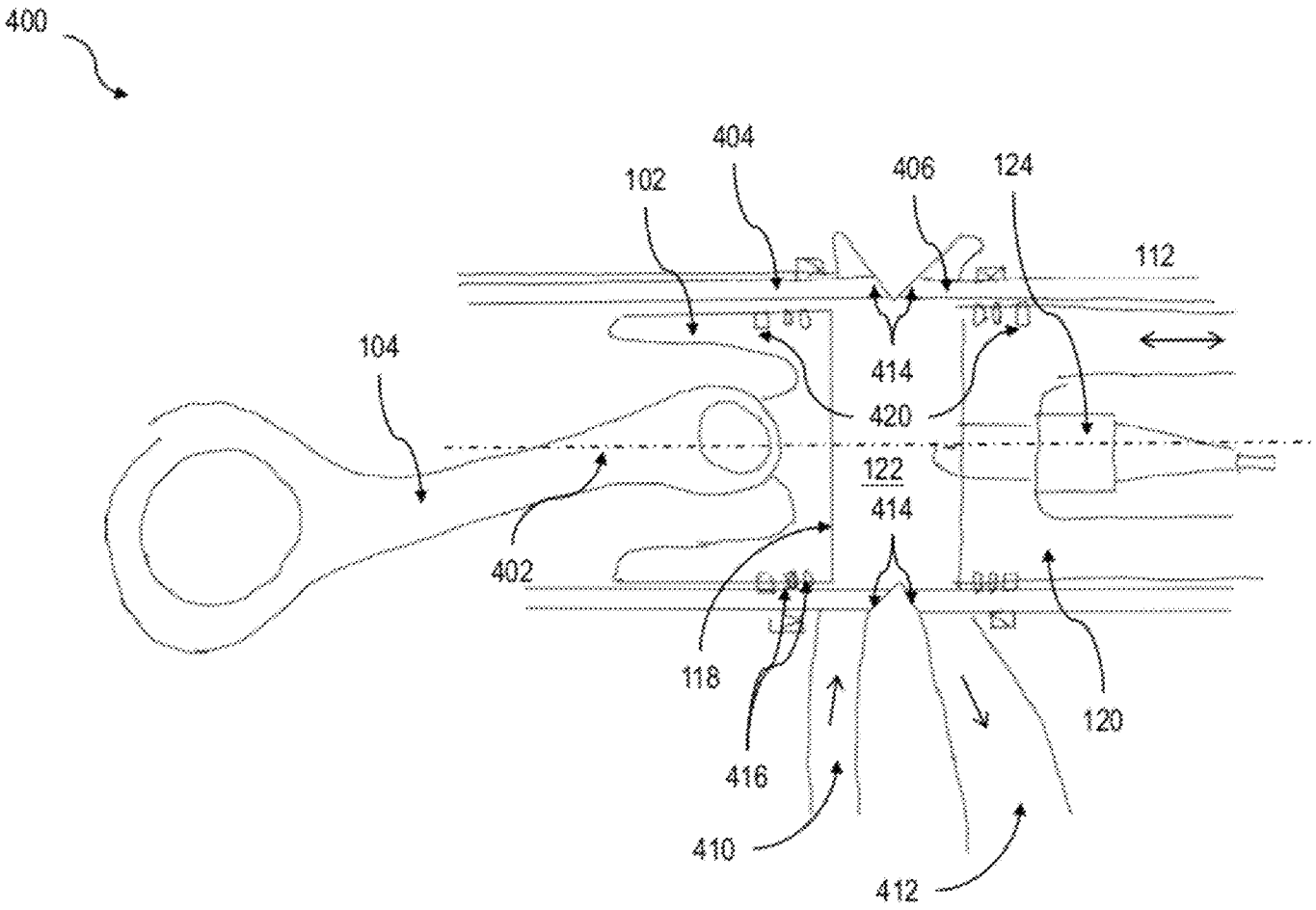
FIG. 4 shows a cross-sectional diagram showing components of a single piston engine with two sleeve valves and a moveable junk head.

FIG. 4 shows a cross-sectional view of an engine 400 in which a cylinder includes a junk head 120 that is moveable such that a compression ratio within the cylinder can be varied from one engine cycle to another, subsequent engine cycle. The junk head 120 can be translated in a direction parallel to the central axis 402 of the cylinder—moving the junk head 120 to the left in the view shown in FIG. 4 reduces the clearance volume and thereby increases the compression ratio, while moving the junk head 120 to the right enlarges the clearance volume and thereby decreases the compression ratio. In typical operation according to an implementation of the current subject matter, motion of the junk head occurs on substantially longer time scales and with a slower frequency than the reciprocating motion of the piston in the cylinder.

In the example of FIG. 4, a first sleeve valve 404 and a second sleeve valve 406 are included to control the opening and closing of an intake port 410, and an exhaust port 412, respectively. Either or both of the intake port 410 and the exhaust port 412 can be a swirl or tumble port such as those described in co-pending and co-owned U.S. patent application Ser. No. 12/860,061 ("High Swirl Port") and co-pending and co-owned international patent application no. PCT/US2011/027775 ("Multi-Mode High Efficiency Internal Combustion Engine"), the disclosure of each of which is incorporated by reference herein. Either or both of these ports may wrap entirely or at least partially about the circumference of the cylinder (as is shown in FIG. 4). Sealing edges of the sleeve valves 404, 406 can form a seal at valve seats 414. As shown in FIG. 4, the exhaust port 412 is located closer to the junk head 120. However, a reversed configuration, in which the intake port is closer to the junk head 120, is also within the scope of the current subject matter.

Both of the junk head 120 and the piston 102 are moveable within the cylinder, albeit at differing frequencies. The first sleeve valve 404 and the second sleeve valve 406 also move within the cylinder relative to the piston 102 and junk head 120. Accordingly, one or more compression piston rings 416 and oil sealing piston rings 420 can be provided about the circumference of each of the piston 102 and the junk head 120. Further, the oil sealing ring 420 can optionally be replaced by a polymer seal with the addition of a blow-by gas vent between the compression ring and the polymer seal.

The piston 102 moves in accordance with the engine cycle within the cylinder to drive the connecting rod to turn the crankshaft as discussed above. The junk head 120, in contrast, can be controlled to move according to a throttle setting or engine operating condition. A controller device (not shown in FIG. 4), which can include one or more programmable processors, can send commands to a junk head translation system to cause the junk head 120 to translate within the cylinder according to a currently required compression ratio. The required compression ratio can be determined by the controller device based on one or more factors, including current engine speed, current engine load, detection of premature detonation within the cylinder (e.g. engine "knocking"), current operation of a turbocharger or supercharger that pressurizes and accordingly adds heat to the intake gases, and the like.

Figure 5:
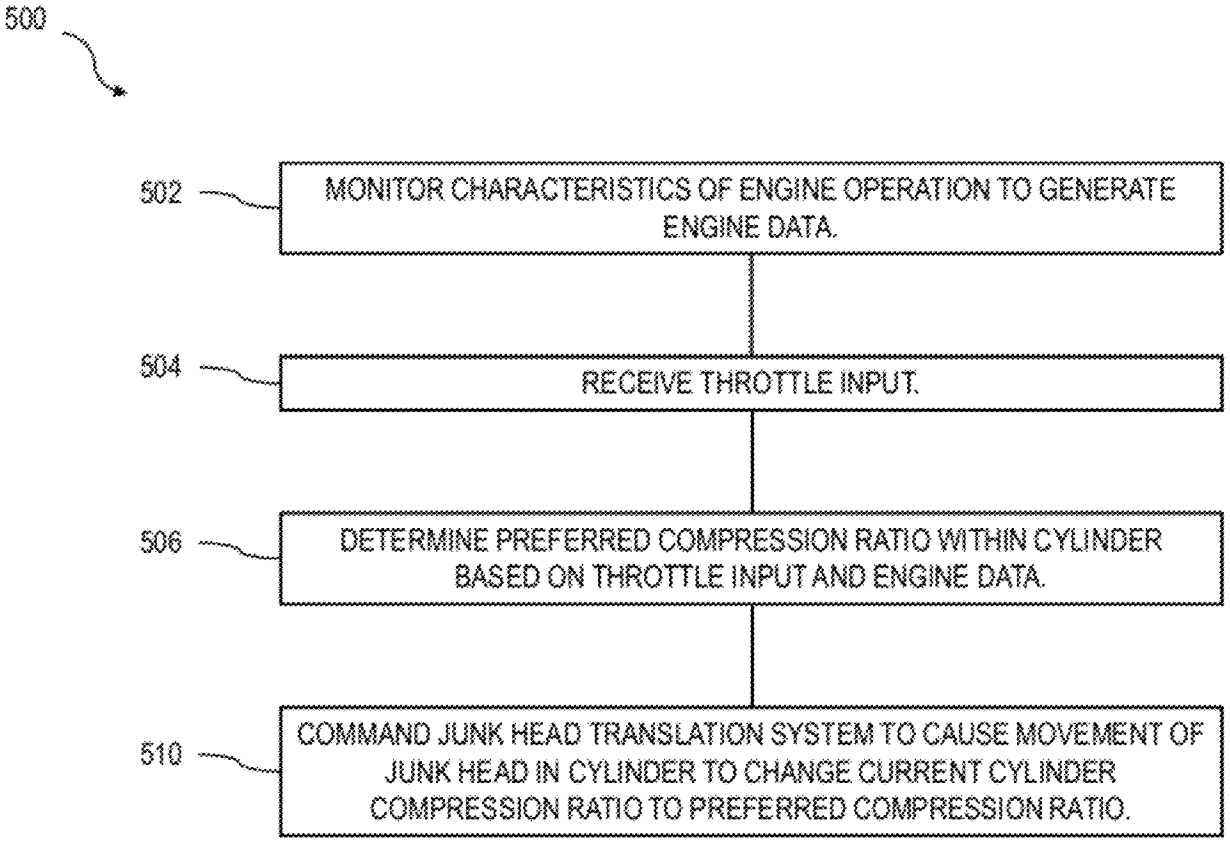
FIG. 5 shows a process flow diagram illustrating aspects of a method having one or more features consistent with implementations of the current subject matter.

As noted above, motion of the junk head generally occurs on substantially longer time scales and with a slower frequency than the reciprocating motion of the piston in the cylinder. For example, while the piston 102 may make one or more complete cycles between a bottom dead center (BDC) and a top dead center (TDC) position and back during each engine cycle (e.g. one cycle between BDC and TDC and back to BDC for a two-stroke engine, two cycles between BDC and TDC and back to BDC for a four-stroke engine, etc.), the junk head 120 tends to move substantially more slowly. A complete cycle of the junk head 120, for example between a first, lower compression ratio position to a second, higher compression ratio position and back to the first, lower compression ratio position can occur during operation of the engine, albeit over many engine cycles rather than during a single engine cycle FIG. 5 shows a process flow chart 500 illustrating method features, one or more of which are consistent with at least one implementation of the current subject matter. At 502, one or more characteristics of operation of an internal combustion engine are monitored to generate engine data. The engine data can include, but are not limited to, one or more of a current engine load, a current engine speed, an intake temperature, a richness of a fuel mixture being delivered to a combustion chamber of the engine, an amount of pre-compression of intake air, and the like. A controller device receives a throttle input for an internal combustion engine at 504. Based on the throttle input and one or more of the other data, the controller device can, at 506 determine a preferred compression ratio within a cylinder of the internal combustion engine. At 510, the controller device can send a command to a junk head translation system to cause a junk head in the cylinder to move to change a current compression ratio in the cylinder to match the preferred compression ratio. The preferred compression ratio can optionally be determined and applied to each cylinder in a multi-cylinder engine. Alternatively, the controller device can determine a preferred compression ratio for each cylinder individually. Such an approach can be useful, particularly in a dynamic load regime, in which one portion of the engine has warmed up more quickly and become more knock prone than another; This approach can provide significant advantages for an engine running in a homogeneous charge compression ignition (HCCI) mode, in which well-mixed fuel and air (or some other oxidizer) are compressed to the point of auto-ignition. In such an engine, control over the factors influencing the ignition timing can be quite important.

Figure 6:
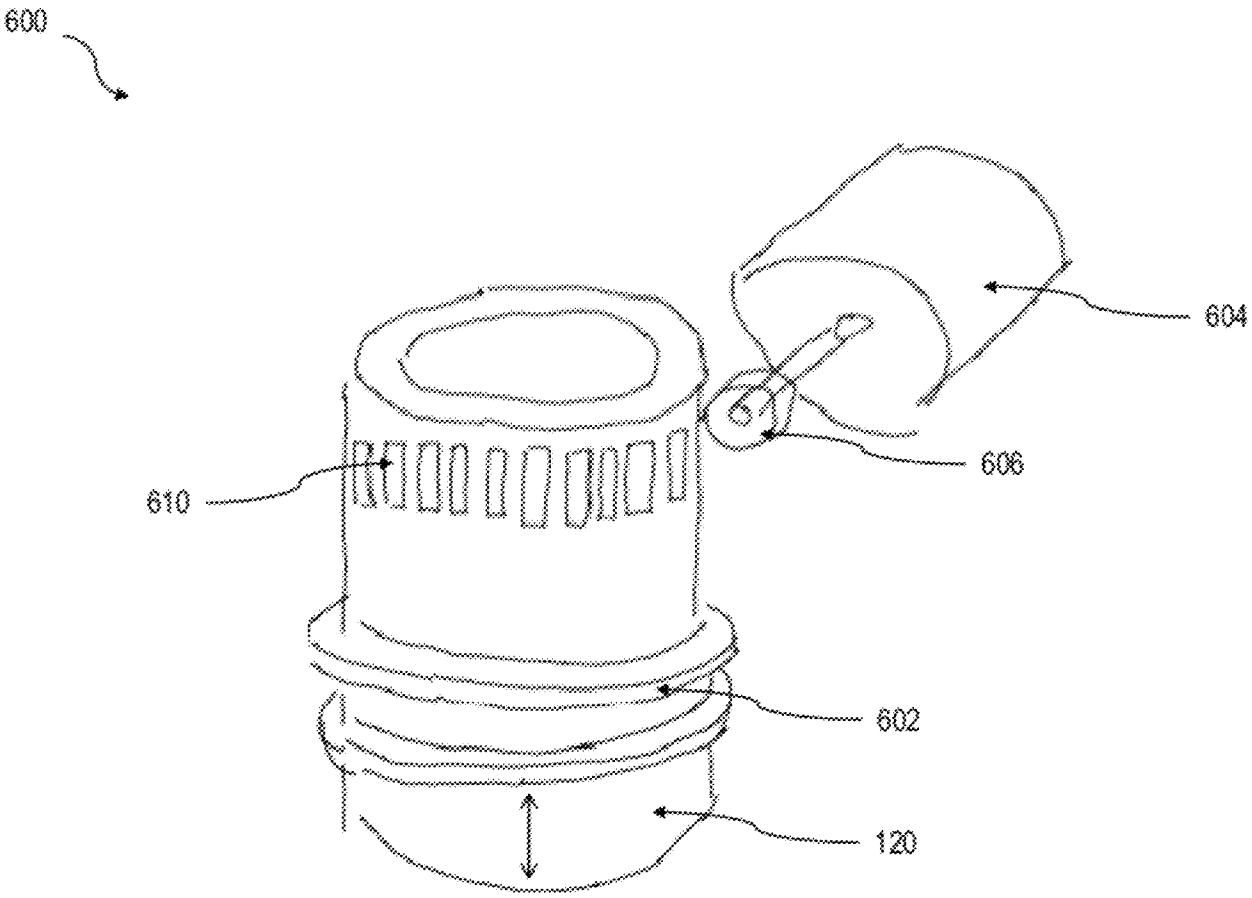
FIG. 6 shows an isometric diagram illustrating an example of a junk head translation system.

FIG. 6 shows an illustrative example of a junk head translation system 600. As shown in this example, a junk head 120 can include a threaded region 602 that is configured to engage with a similarly tapped section of the engine block within a cylinder. A motor 604, which can be electric, hydraulic, belt driven, or the like, can rotate a worm drive 606 on command from the controller device. The worm drive 606 can engage with a series of teeth 610 on the junk head 120 to cause rotation of the junk head. Rotation of the junk head 120 in a first direction can cause the junk head 120 to move further into the cylinder by interaction of the threaded region 602 with the tapped section of the engine block. Rotation of the junk head 120 in a second direction opposite to the first direction can cause the junk head 120 to move back out of the cylinder by interaction of the threaded region 602 with the tapped section of the engine block. While FIG. 6 shows an example in which a threaded region 602 of the junk head engages with a tapped section of the engine block, the scope of the current subject matter also includes an alternative implementation in which the junk head 120 includes a tapped section that interacts with a threaded region of the ending block, a threaded adjustment assembly between the block and the junk head, or the like, which can allow the junk head to remain rotationally fixed relative to the main body of the engine.

Figure 7:
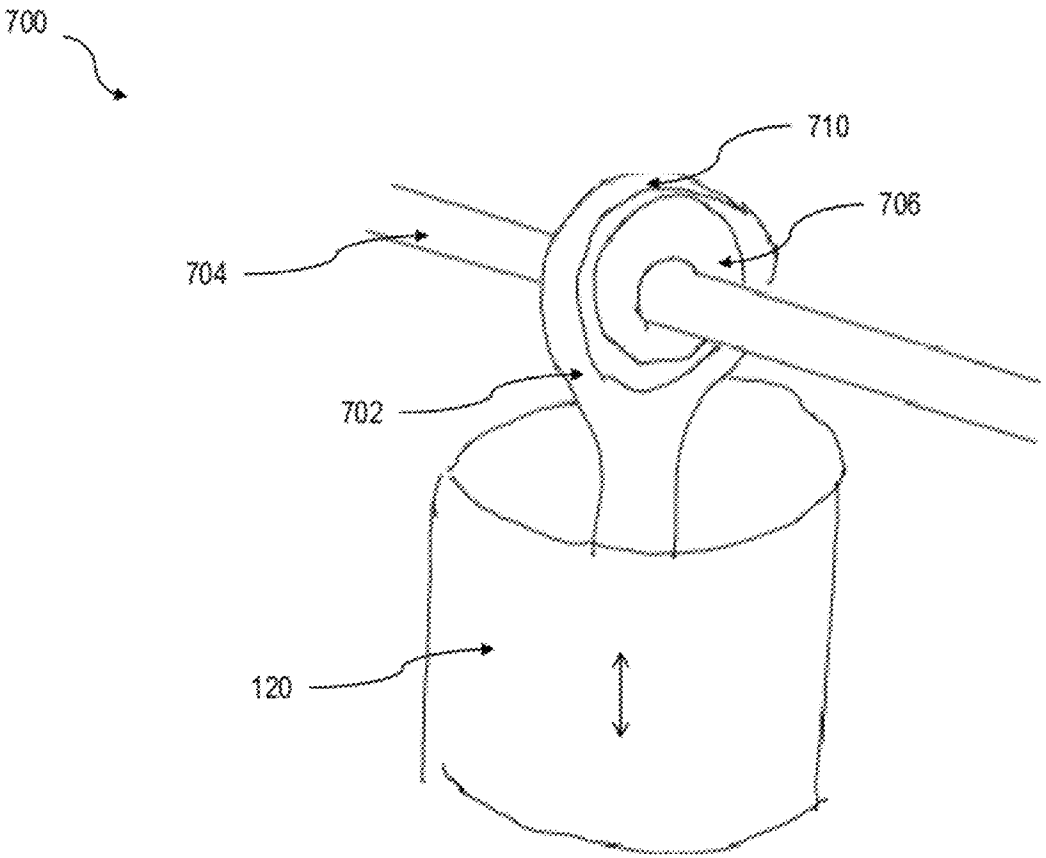
FIG. 7 shows an isometric diagram illustrating another example of a junk head translation system.

FIG. 7 shows an illustrative example of another junk head translation system 700. As shown in this example, a junk head 120 can be connected via a connecting rod 702 to a cam shaft 704 than can be rotated on command from the controller device, for example by a motor, which can be electric, hydraulic, belt-driven, etc. The cam shaft 704 can include an eccentric or off-center cam lobe 706 that is mounted to the cam shaft 704 at a rotation point that is not at the central axis of rotation of the cam lobe 706 such that when the cam shaft 704 is rotated, the cam lobe 706 acts on the end 710 of the connecting rod 702 to result in lifting or dropping the junk head within the cylinder.

Figure 8:
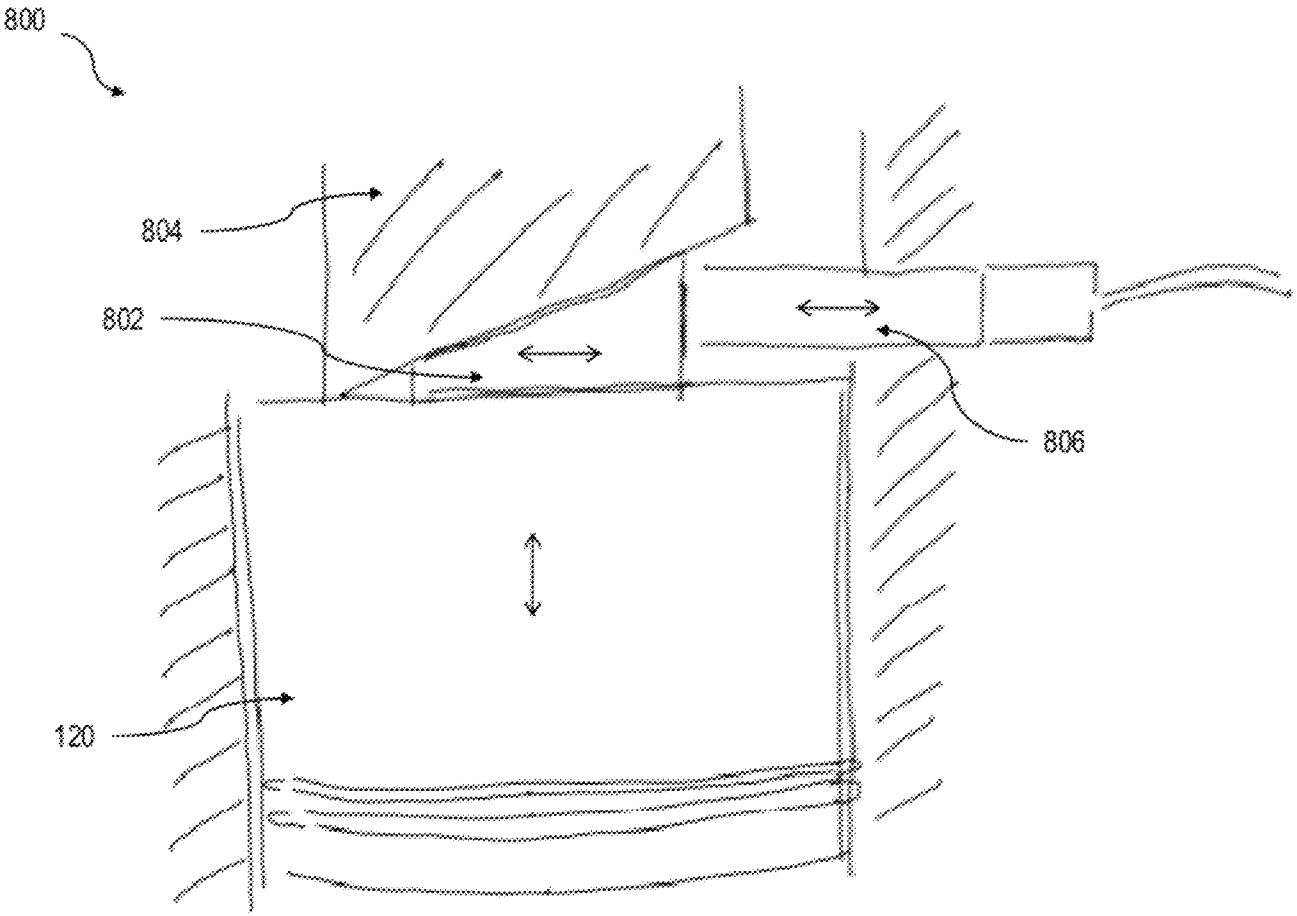
FIG. 8 shows a cross-sectional diagram illustrating yet another example of a junk head translation system.

FIG. 8 shows an illustrative example of yet another junk head translation system 800. As shown in this example, a wedge 802 can be driven between a fixed block 804 or other feature in the engine block and the junk head 120 such that as the wedge 802 is moved in one direction, the junk head 120 is caused to move along another axis. The wedge can be driven by a hydraulic drive 806 as shown in FIG. 8, or alternatively by other types of drives (e.g. a threaded drive, a belt drive, etc.).

In another implementation, the junk head 120 is neither fixed to the main engine assembly nor rigidly coupled to a junk head translation system 700 that controls movement on times scales longer than an engine cycle. Rather, an elastic junk head rebound mechanism, such as for example a backing spring or the like, can hold the junk head 120 against a stop with a certain preload force applied. The applied preload force can hold the junk head 120 stationary against the stop until the pressure in the combustion chamber acting against the junk head 120 overcomes the preload force provided by the spring or other elastic junk head rebound mechanism. When the junk head is lifted from the stop position by the chamber pressure, further additions of energy to the gas, whether from compression or from combustion, increase the volume the of the combustion chamber by compressing the spring or other elastic junk head rebound mechanism, while also increasing the pressure in the combustion chamber. For a given energy addition, the combustion chamber pressure and the gas temperature will be lower than if the junk head 120 was fixed in position for the duration of the engine cycle. As the pressure decreases, the spring or other elastic junk head rebound mechanism pushes the junk head 120 back toward its fixed position against the stop and the energy stored in the spring or other elastic junk head rebound mechanism is returned to the working fluid in the combustion chamber. By setting the preload force of the spring or other elastic junk head rebound mechanism, an approximate peak pressure for engine operation can be set. Adjusting the spring or other elastic junk head rebound mechanism preload force to set the peak pressure allows a degree of control over peak temperatures in the combustion process, such as at full power operation, at which the combustion event can be susceptible to knock due to high peak pressures and temperatures. Gas loads on the valves and other components can also be reduced by limiting the peak pressure. In various implementations, an elastic junk head rebound mechanism as described above can be used in conjunction with either an otherwise fixed junk head position or with a junk head translation mechanism that can translate the location of the stop from one engine cycle to a later engine cycle.

Figure 9:
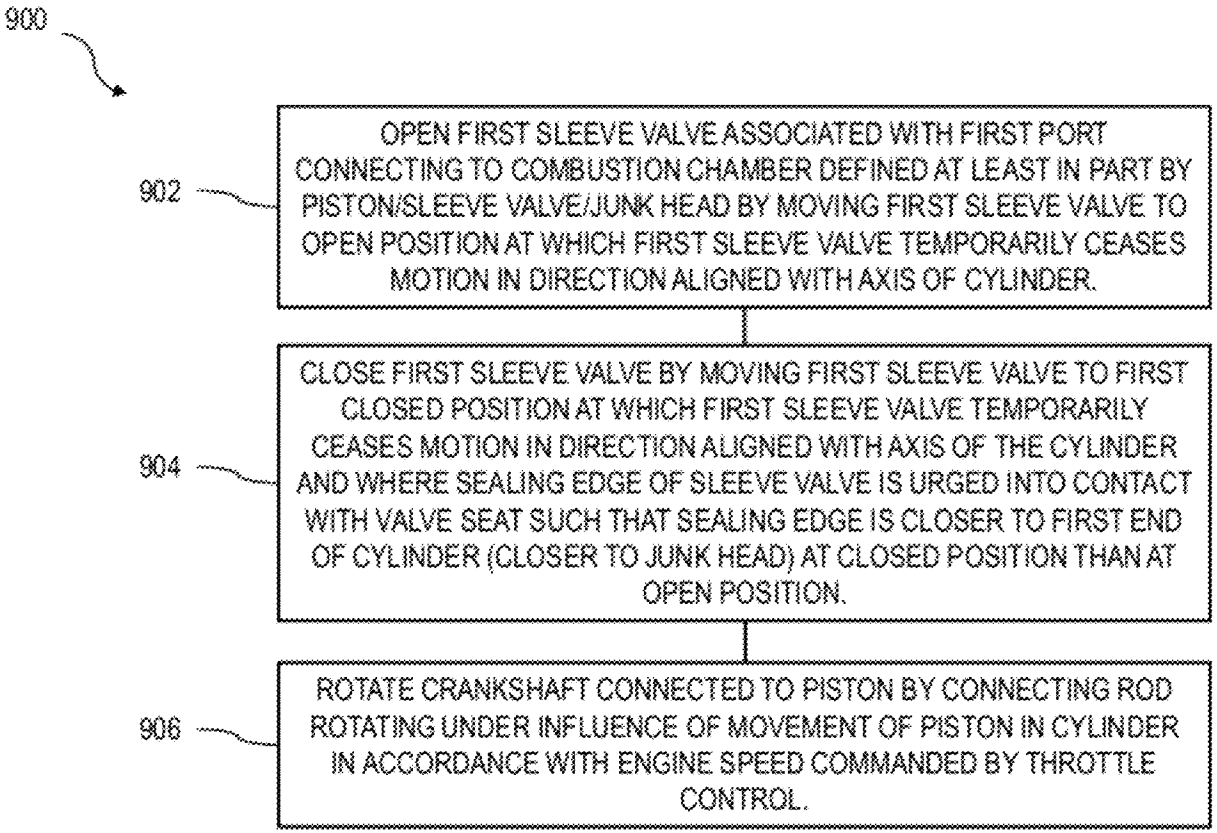
FIG. 9 shows a process flow chart illustrating aspects of a method having one or more features consistent with implementations of the current subject matter.

FIG. 9 shows a process flow chart 900 illustrating method features, one or more of which are consistent with at least one implementation of the current subject matter. At 902, a first sleeve valve associated with a first port connecting to a combustion chamber is opened. The combustion chamber is disposed within a cylinder of an internal combustion engine and defined at least in part by a head of a piston that moves within the cylinder, an internal surface of a junk head disposed at a first end of the cylinder opposite the piston, and the first sleeve valve, which at least partially encircles the piston. The opening includes moving the first sleeve valve to an open position at which the first sleeve valve temporarily ceases its motion in a direction aligned with an axis of the cylinder. At 904, the first sleeve valve is closed by moving the first sleeve valve to a first closed position at which the first sleeve valve temporarily ceases its motion in the direction aligned with the axis of the cylinder and at which a sealing edge of the sleeve valve is urged into contact with a valve seat such that the sealing edge is closer to the first end of the cylinder at the closed position than at the open position. At 906, a crankshaft connected to the piston by a connecting rod rotates under influence of movement of the piston in the cylinder in accordance with an engine speed commanded by a throttle control.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system may include clients and servers. A client and server are generally remote from each other and typically interact through a communication network. The relationship of client and server arises by virtue of computer programs running on the respective computers and having a client-server relationship to each other.

These computer programs, which can also be referred to as programs, software, software applications, applications, components, or code, include machine instructions for a programmable processor, and can be implemented in a high-level procedural and/or object-oriented programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example as would a processor cache or other random access memory associated with one or more physical processor cores.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and subcombinations of the disclosed features and/or combinations and subcombinations of several further features disclosed above. In addition, the logic flows depicted in the accompanying figures and/or described herein do not necessarily require the particular order shown, or sequential order, to achieve desirable results. Other implementations or embodiments may be within the scope of the following claim.

What is claimed is:

1. A system comprising:

a piston that moves within a cylinder of an internal combustion engine;

a crankshaft connected to the piston by a connecting rod, the crankshaft rotating under influence of movement of the piston in the cylinder in accordance with an engine speed commanded by a throttle control;

a junk head disposed opposite the piston proximate to a first end of the cylinder; and a first sleeve valve associated with a first port connecting to a combustion chamber defined at least in part by a head of the piston, an internal surface of the junk head, and the first sleeve valve, the first sleeve valve at least partially encircling the piston and opening and closing the first port by first movement between a first open position and a first closed position, a first sealing edge of the first sleeve valve being urged into contact with the first valve seat at the first closed position such that the first sealing edge is closer to the first end of the cylinder at the first closed position than at the first open position, the first movement comprising the first sleeve valve temporarily ceasing its motion in a direction aligned with an axis of the cylinder at the first closed position and at the first open position.

2. A system as in claim 1, further comprising a coolant circulation system that causes coolant to flow through one or more coolant channels in the junk head to maintain an internal surface of the junk head at or below a target junk head temperature.

3. A system as in claim 1, further comprising an ignition source disposed in the junk head.

4. A system as in claim 1, further comprising a second valve associated with a second port connecting to the combustion chamber, the second valve comprising either a second sleeve valve at least partially encircling the junk head or one or more poppet valves disposed in the junk head, wherein if the second valve is the second sleeve valve, the second sleeve opens and closes the second port by second movement between a second open position and a second closed position, the second closed position comprising a second sealing edge of the second sleeve valve being urged into contact with a second valve seat such that the second sealing edge is further from the first end of the cylinder at the second closed position than at the second open position, the second movement comprising the second sleeve valve ceasing its motion in the direction aligned with the axis of the cylinder both at the second closed position and at the second open position.

5. A system as in claim 4, wherein the first port comprises an intake port through which at least one of intake air and an air-fuel mixture is delivered to the combustion chamber, and the second port comprises an exhaust port through which exhaust gases resulting from combustion of a combustion mixture in the combustion chamber are exhausted.

6. A system as in claim 4, wherein the second port comprises an intake port through which at least one of intake air and an air-fuel mixture is delivered to the combustion chamber, and the first port comprises an exhaust port through which exhaust gases resulting from combustion of a combustion mixture in the combustion chamber are exhausted.

7. A system as in claim 4, further comprising an active cooling system associated with at least one of the first sleeve valve and the second valve to maintain the at least one of the first sleeve valve and the second valve at or below a target valve temperature.

8. A system as in claim 7, wherein the second valve comprises the one or more poppet valves, and the active cooling system comprises an oil supply tube inserted into a valve stem of the one or more poppet valves to deliver oil near a valve head of the one or more poppet valves and thereby maintain an internal surface valve head at or below the target valve head temperature.

9. A system as in claim 1, further comprising:

a junk head translation system to cause movement of the junk head in the cylinder such that a distance of the junk head from a top dead center position of the piston is variable from a first cycle of the internal combustion engine to a second, later cycle of the internal combustion engine; and a controller configured to perform operations comprising:

monitoring operation characteristics of the internal combustion engine to generate engine data;

receiving a throttle input from the throttle control;

determining a preferred compression ratio within the combustion chamber based on the engine data and the throttle input; and commanding the junk head translation system to cause movement of the junk head in the direction to provide the preferred compression ratio, the command causing the junk head translation system to move the junk head closer to the top dead center position of the piston if the preferred compression ratio is greater than a current compression ratio and away from the top dead center position of the piston if the preferred compression ratio is less than the current compression ratio.

10. A system as in claim 9, wherein the engine data comprise at least one of a current engine speed, a current engine load, a detection of a premature detonation within the combustion chamber, and a current operation of a turbocharger or a supercharger that pressurizes and therefore adds heat to inlet air delivered to the combustion chamber.

11. A system as in claim 1, further comprising an elastic rebound mechanism that biases the junk head against a stop with a preload force directed away from the first end of the cylinder, the preload force being sufficient to retain the junk head against the stop up to a threshold combustion chamber pressure such that the junk head moves toward the first end of the cylinder to increase a combustion chamber volume during an engine cycle when the threshold combustion chamber pressure is exceeded.

12. A method comprising:

opening a first sleeve valve associated with a first port connecting to a combustion chamber disposed within a cylinder of an internal combustion engine and defined at least in part by a head of a piston that moves within the cylinder, an internal surface of a junk head disposed proximate to a first end of the cylinder opposite the piston, and the first sleeve valve, the first sleeve valve at least partially encircling the piston, the opening comprising moving the first sleeve valve to an open position at which the first sleeve valve temporarily ceases its motion in a direction aligned with an axis of the cylinder;

closing the first sleeve valve, the closing comprising moving the first sleeve valve to a first closed position at which the first sleeve valve temporarily ceases its motion in the direction aligned with the axis of the cylinder and at which a sealing edge of the sleeve valve is urged into contact with a valve seat such that the sealing edge is closer to the first end of the cylinder at the closed position than at the open position; and rotating a crankshaft connected to the piston by a connecting rod, the crankshaft rotating under influence of movement of the piston in the cylinder in accordance with an engine speed commanded by a throttle control.

13. A method as in claim 12, further comprising causing coolant to flow through one or more coolant channels in the junk head to maintain an internal surface of the junk head at or below a target junk head temperature.

14. A method as in claim 12, wherein the internal combustion engine further comprises a second valve associated with a second port connecting to the combustion chamber, the second valve comprising either a second sleeve valve at least partially encircling the junk head or one or more poppet valves, wherein if the second valve is the second sleeve valve, the second sleeve valve opens and closes the second port by second movement between a second open position and a second closed position, the second closed position comprising a second sealing edge of the second sleeve valve being urged into contact with a second valve seat such that the second sealing edge is further from the first end of the cylinder at the second closed position than at the second open position, the second movement comprising the second sleeve valve ceasing its motion in the direction aligned with the axis of the cylinder both at the second closed position and at the second open position.

15. A method as in claim 14, further comprising maintaining the at least one of the first sleeve valve and the second valve at or below a target valve temperature using an active cooling system associated with at least one of the first sleeve valve and the second valve.

16. A method as in claim 14, wherein the second valve comprises the one or more poppet valves, and the active cooling system comprises an oil supply tube inserted into a valve stem of the one or more poppet valves to deliver oil near a valve head of the one or more poppet valves and thereby maintain an internal surface valve head at or below the target valve head temperature.

17. A method as in claim 12, further comprising:

causing movement of the junk head in the cylinder using a junk head translation system;

monitoring operation characteristics of the internal combustion engine to generate engine data;

receiving a throttle input from the throttle control;

determining a preferred compression ratio within the combustion chamber based on the engine data and the throttle input; and commanding a junk head translation system that varies a distance between the junk head and a top dead center position of the piston from a first cycle of the internal combustion engine to a second, later cycle of the internal combustion engine, the commanding comprising causing the junk head translation system to move the junk head closer to the top dead center position of the piston if the preferred compression ratio is greater than a current compression ratio and away from the top dead center position of the piston if the preferred compression ratio is less than the current compression ratio.

18. A method as in claim 17, wherein the engine data comprise at least one of a current engine speed, a current engine load, a detection of a premature detonation within the combustion chamber, and a current operation of a turbocharger or a supercharger that pressurizes and therefore adds heat to inlet air delivered to the combustion chamber.

19. A method as in claim 12, further comprising biasing the junk head against a stop with a preload force directed away from the first end of the cylinder, the preload force being sufficient to retain the junk head against the stop up to a threshold combustion chamber pressure such that the junk head moves toward the first end of the cylinder to increase a combustion chamber volume during an engine cycle when the threshold combustion chamber pressure is exceeded.

20. A method comprising:

monitoring operation characteristics of an internal combustion engine to generate engine data, the internal combustion engine comprising a piston moving in a cylinder and a junk head disposed proximate to a first end of the cylinder opposite the piston, wherein the junk head is not attached, either directly or via a connecting rod, to a crankshaft for power output;

receiving a throttle input from a throttle control of the internal combustion engine;

determining a preferred compression ratio within the combustion chamber based on the engine data and the throttle input;

commanding a junk head translation system that varies a distance between the junk head and a top dead center position of the piston from a first cycle of the internal combustion engine to a second, later cycle of the internal combustion engine, the commanding comprising causing the junk head translation system to move the junk head closer to the top dead center position of the piston if the preferred compression ratio is greater than a current compression ratio and away from the top dead center position of the piston if the preferred compression ratio is less than the current compression ratio; and closing a first sleeve valve, the closing comprising moving the first sleeve valve to a first closed position at which the first sleeve valve temporarily ceases its motion in the direction aligned with the axis of the cylinder and at which a sealing edge of the sleeve valve is urged into contact with a valve seat such that the sealing edge is closer to the first end of the cylinder at the closed position than at the open position.

21. A system as in claim 1, wherein the junk head comprises a compression or oil-sealing piston ring, and wherein the junk head is stationary in the cylinder.

22. A system as in claim 1, wherein the junk head comprises a compression or oil-sealing piston ring, and wherein the junk head is moveable between at least two positions to vary a distance between the junk head and a top dead center position of the piston, the varying of the distance occurring at a rate governed by the throttle control rather than by a speed at which the internal combustion engine is operating.

23. A system as in claim 1, wherein the first valve seat forms a part of the first port.

* * * * *